US009711070B2

(12) United States Patent
Greene

(10) Patent No.: US 9,711,070 B2
(45) Date of Patent: Jul. 18, 2017

(54) ILLUMINATED SIGNAGE

(71) Applicant: Hal Jay Greene, Denver, CO (US)

(72) Inventor: Hal Jay Greene, Denver, CO (US)

( * ) Notice: Subject to any disclaimer, the term of this patent is extended or adjusted under 35 U.S.C. 154(b) by 0 days.

(21) Appl. No.: 14/539,131

(22) Filed: Nov. 12, 2014

(65) Prior Publication Data

US 2015/0199926 A1 Jul. 16, 2015

Related U.S. Application Data

(60) Provisional application No. 61/923,001, filed on Jan. 2, 2014.

(51) Int. Cl.

| | |
|---|---|
| ***G09F 19/08*** | (2006.01) |
| ***G09F 11/23*** | (2006.01) |
| ***G09F 13/10*** | (2006.01) |
| ***G09F 11/04*** | (2006.01) |
| ***G09F 13/08*** | (2006.01) |
| ***G09F 19/02*** | (2006.01) |

(52) U.S. Cl.

CPC ..... *G09F 11/23* (2013.01); *G09F 11/04* (2013.01); *G09F 13/08* (2013.01); *G09F 13/10* (2013.01); *G09F 19/02* (2013.01)

(58) Field of Classification Search

CPC ..... G09F 2019/088; G09F 11/04

USPC ..... 40/564, 416, 441, 433, 442, 430, 493; 434/101, 104, 206, 402

See application file for complete search history.

(56) References Cited

U.S. PATENT DOCUMENTS

| | | | | |
|---|---|---|---|---|
| 1,803,598 | A | 5/1931 | Craig | |
| 1,981,033 | A | 11/1934 | Dina | |
| 2,137,127 | A * | 11/1938 | Best | 40/444 |
| 2,827,829 | A | 3/1958 | Spitz | |
| 2,891,338 | A | 6/1959 | Palamara | |
| 2,904,913 | A | 9/1959 | Derringer | |
| 3,076,278 | A | 2/1963 | Zack | |
| 3,178,843 | A | 4/1965 | Hammer | |
| 3,205,598 | A | 9/1965 | Grosse | |
| 3,440,349 | A * | 4/1969 | Gibbs | 340/540 |
| 3,681,917 | A | 8/1972 | Kroeger | |
| 3,683,526 | A | 8/1972 | Horvath | |
| 3,732,560 | A | 5/1973 | Harden | |
| 3,759,524 | A | 9/1973 | McNaney | |
| 3,797,012 | A * | 3/1974 | Gibbs et al. | 340/815.56 |
| 3,839,701 | A | 10/1974 | Pomerantz | |
| 4,244,130 | A | 1/1981 | Frois | |
| 4,698,927 | A * | 10/1987 | Yoshiro | 40/1.6 |
| 5,406,729 | A * | 4/1995 | Bejin | 40/433 |
| 5,862,615 | A * | 1/1999 | O'Rourke | 40/1.6 |
| 6,761,468 | B1 * | 7/2004 | Bogal | 362/208 |
| 7,174,664 | B2 | 2/2007 | Spencer | |
| 7,308,768 | B2 | 12/2007 | Rice | |

(Continued)

OTHER PUBLICATIONS

Lindsey Skinner Sorry No Candy Glowing Sign Website: http://mommymiaa.blogspot.com/2013/10/sorry-no-candy-sign.html Dated Saturday, Oct. 5, 2013.

*Primary Examiner* — Kristina Junge

(57) ABSTRACT

An illuminated signage includes a light source, a first light transmissive element having first facial features on it and being in a fixed position to convey a fixed message, and a second light transmissive element having second facial features and being in a moveable position relative to the fixed position of the first light transmissive element, to convey a variable message.

4 Claims, 5 Drawing Sheets

(56) References Cited

U.S. PATENT DOCUMENTS

| | | | | |
|---|---|---|---|---|
| D616,945 | S | 6/2010 | Villasenor | |
| 2005/0024862 | A1* | 2/2005 | Laux | 362/186 |

* cited by examiner

ILLUMINATED SIGNAGE

FIELD OF THE INVENTION

The present invention relates to an illuminated signage and, more particularly, to signage that can be illuminated in a plurality of modes as a respective plurality of indicators for a viewer.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

Figure 1:
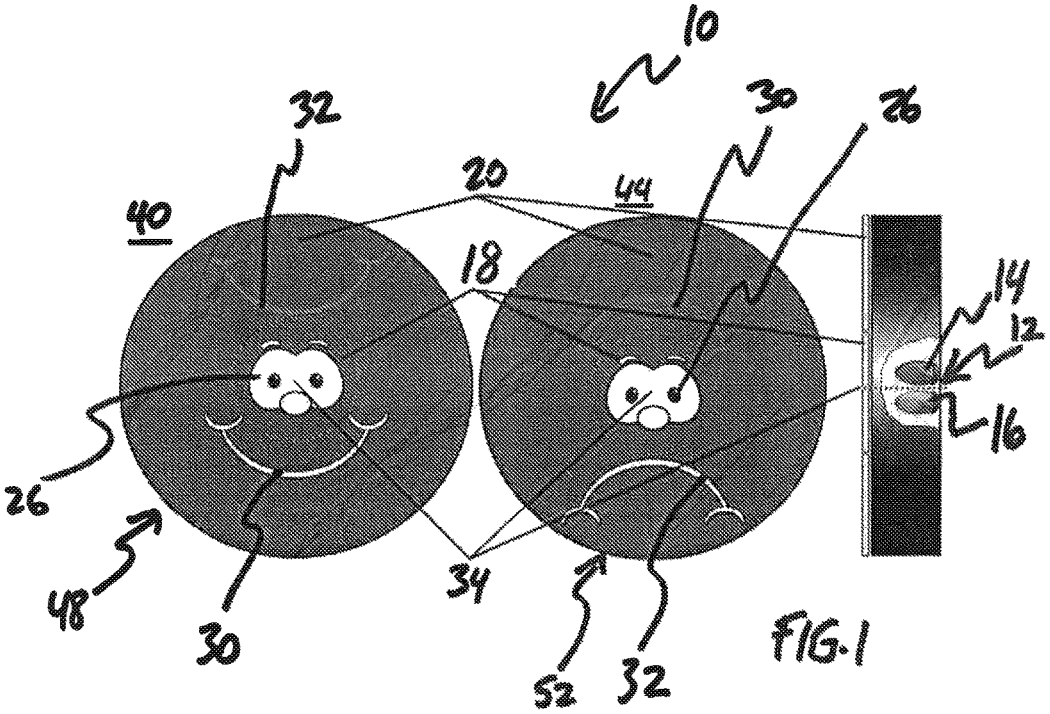
FIG. 1 is a view of an illuminated sign according to an exemplary embodiment of the present invention.

FIG. 1 illustrates an illuminated sign 10 including a light source 12 which has a red light 12 and a green light 14. However, the embodiments of the present invention are not limited to any specific number or color of lights within the light source. The illuminated sign 10 further includes a first light transmissive element 18 in a fixed position with facial features that include eye features 26. The illuminated sign 10 further includes a second light transmissive element 20 in a moveable position relative to the fixed position of the first light transmissive element 18. The second light transmissive element 20 has facial features that include a first mouth feature 30 and a second mouth feature 32. As further illustrated in FIG. 1, the first light transmissive element 18 is an interior portion of the illuminated sign 10 and the second light transmissive element 20 is an outer portion enclosing the interior portion and is rotatable relative to the interior portion. As further illustrated in FIG. 1, an axis of rotation 34 of the second light transmissive element 20 coincides with the first light transmissive element 18 (i.e., the interior portion) of the illuminated sign 10.

During operation of the illuminated sign 10, upon moving the second light transmissive element 20 to a first position 40 (FIG. 1) relative to the first light transmissive element 18, the green light 16 of the light source 12 is configured to emit a green color, such that the first light transmissive element 18 and the second light transmissive element 20 are illuminated with the green color. Additionally, upon moving the second light transmissive element 20 from the first position 40 to a second position 44 (FIG. 1) relative to the first light transmissive element 18, the red light 14 of the light source 12 is configured to emit a red color such that the first light transmissive element 18 and the second light transmissive element 20 are illuminated with the red color. Although the above embodiment discusses that the transmissive elements 18, 20 are illuminated with a green color in the first position 40 and with a red color in the second position 44, the embodiments of the present invention is not limited to any specific color or number of positions/colors. Indeed, the transmissive elements 18, 20 may be illuminated with any first color in the first position 40 and with any second color in the second position 44, provided that the second color is different than the first color and that the light source 12 is configured to provide the first color and the second color. The sign 10 includes a switch (not shown) which may be electronic or mechanical, to turn on the green light 16 when the second light transmissive element 20 is in the first position 40 and to turn on the red light 14 when the second light transmissive element 20 is in the second position 44.

As further illustrated in FIG. 1, upon moving the second light transmissive element 20 to the first position 40 relative to the first light transmissive element 18, the facial features including the mouth feature 30 of the second light transmissive element 20 are oriented to convey a positive indication 48. Specifically, the positive indication 48 is based on the eye features 26 of the first light transmissive element 18 and the mouth feature 30 of the second light transmissive element 20 being positioned in a smiling orientation while being illuminated with the green color from the green light 16.

As further illustrated in FIG. 1, upon moving the second light transmissive element 20 to the second position 44 relative to the first light transmissive element 18, the facial features including the mouth feature 32 of the second light transmissive element 20 are oriented to convey a negative indication 52. Specifically, the negative indication 52 is based on the eye features 26 of the first light transmissive element 18 and the mouth feature 32 of the second light transmissive element 20 being in a sad orientation while being illuminated with the red color from the red light 14. A baffle (not shown) is positioned behind the first and second light transmissive elements 18, 20, so that it obscures the mouth feature 32 when the second element 20 is moved to the first position 40 to show the positive indication 48 with green color from the green light 16 and so that it obscures the mouth feature 30 when the second element 20 is moved to the second position 44 to show the negative indication 52 with red color from the red light 14.

Figure 2:
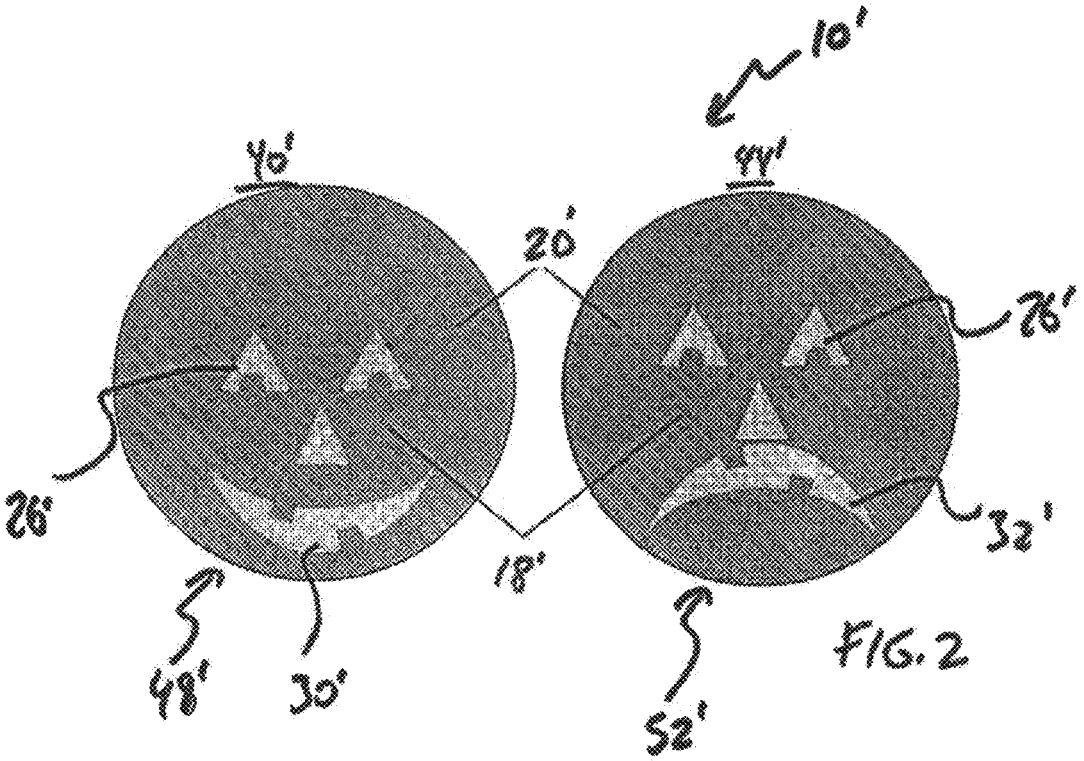
FIG. 2 is a view of an alternate illuminated sign according to an exemplary embodiment of the present invention.

FIG. 2 illustrates an alternate illuminated sign 10' that is similar to the illuminated sign 10 of FIG. 1, where the illuminated sign 10' takes the form of a pumpkin. As with the illuminated sign 10 of FIG. 1, the illuminated sign 10' includes a first light transmissive element 18' and a second light transmissive element 20', where the first light transmissive element 18' is in a fixed position and the second light transmissive element 20' is rotatable relative to the first light transmissive element 18'. Unlike the illuminated sign 10 of FIG. 1, the light source (not shown) of the illuminated sign 10' of FIG. 2 includes an orange light and a red light. Upon moving the second transmissive element 20' to the first position 40', the facial features including the mouth feature 30' are oriented to convey a positive indication 48' based on eye features 26' of the first transmissive element 18' and the mouth feature 30' of the second transmissive element 20' being in a positive orientation while being illuminated with an orange color from the orange light of the light source. Upon moving the second transmissive element 20' to the second position 44', the facial features including the mouth feature 32' are oriented to convey a negative indication 52' based on eye features 26' of the first transmissive element 18' and the mouth feature 32' of the second transmissive element 20' being in a negative orientation while being illuminated with a red color from the red light of the light source. In an exemplary embodiment, the illuminated sign 10' of the pumpkin may be positioned over a bowl of candy outside a home during Halloween, for example. The illuminated sign 10' may be positioned in the first position 40' to convey the positive indication 48' that candy remains in the bowl, and the illuminated sign 10' may be positioned in the second position 44' to convey the negative indication 52' when the bowl is emptied of candy. The illuminated sign 10' may be manually switched between the first and second positions 40', 44' by a user, such as an owner of the home, for example, or may be automatically switched between the first and second positions 40', 44' based on a sensor that detects whether candy remains in the bowl, for example. However, the embodiments of the present invention are not limited to the specific use of the illuminated signs for the positive and negative indications of whether candy remains in a bowl.

Figure 3:
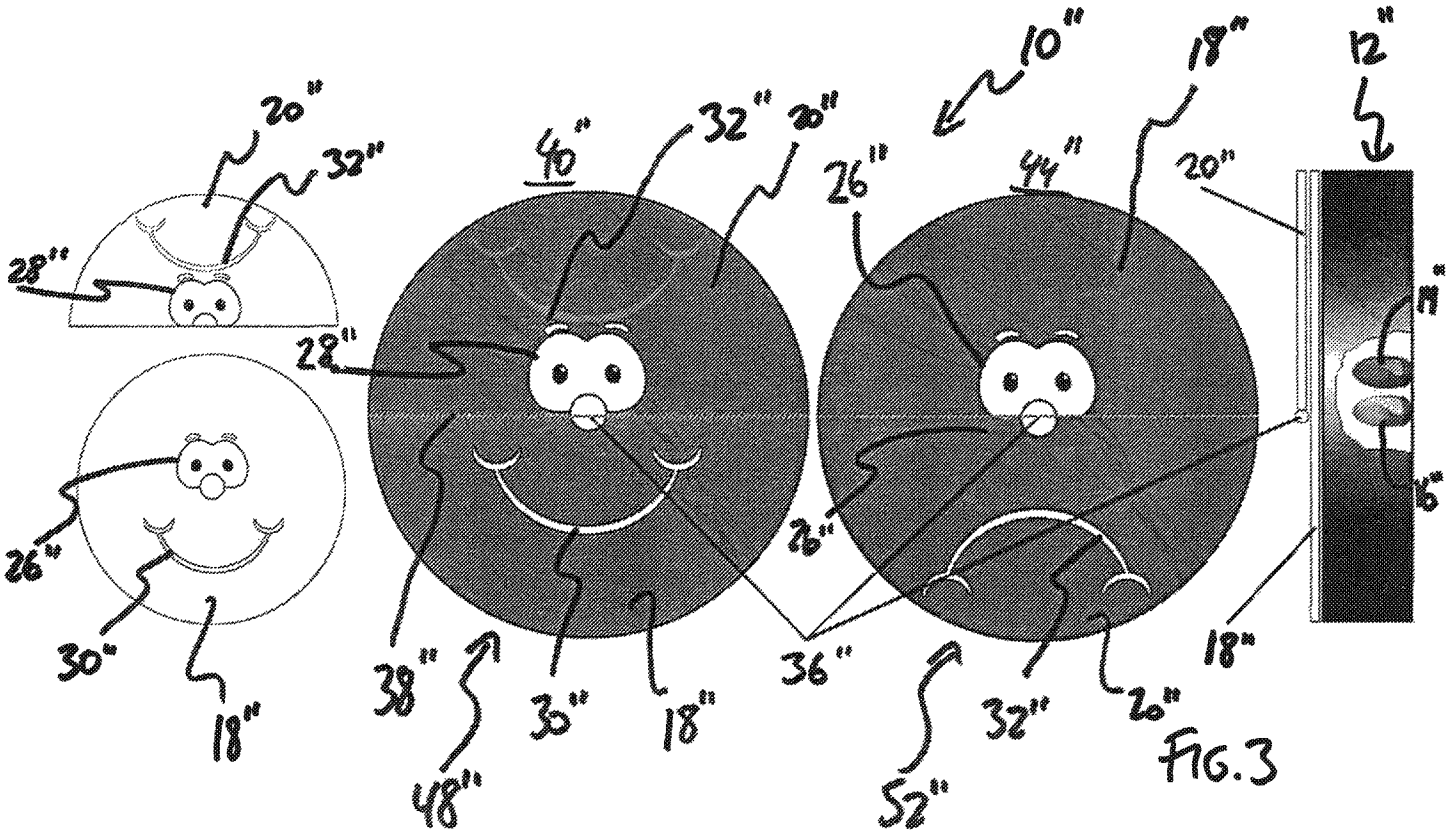
FIG. 3 is a view of an alternate illuminated sign according to an exemplary embodiment of the present invention.

FIG. 3 illustrates an additional embodiment of the illuminated sign 10", where the second light transmissive element 20" is hingedly mounted to a front surface of the first light transmissive element 18". In this particular embodiment, the first light transmissive element 18" has an upper portion and a lower portion and the second light transmissive element 20" has a geometric configuration that is dimensioned to be the same as the upper and lower portion of the first light transmissive element 18". As further illustrated in FIG. 3, the first light transmissive element 18" includes eye features 26" and a mouth feature 30" while the second light transmissive element 20'" includes eye features 28" and a mouth feature 32". As further illustrated in FIG. 3, the illuminated sign 10" includes a hinge 36" of the second light transmissive element 20" that coincides with a boundary 38" between the upper and lower portion. In operation, when the second light transmissive element 20" is in a first position 40" relative to the first light transmissive element 18" (FIG. 3), the facial features including the eye features 28" of the second light transmissive element 20" and the mouth feature 30" of the first light transmissive element 18" are oriented to convey a positive indication 48" while being illuminated by green color from the green light 16". Similarly, when the second light transmissive element 20" is rotated about the hinge 36" from the first position 40" to a second position 44" (FIG. 3) relative to the first light transmissive element 18", the facial features including the eye features 26" of the first light transmissive element 18" and the mouth feature 32" of the second light transmissive element 20" are oriented to convey a negative indication 52" while being illuminated by red color from the red light 14". As with the previous embodiment of the sign 10 in FIG. 1, a baffle (not shown) is provided behind the first and second light transmissive elements 18",20", so that it obscures the mouth feature 32" when the second element 20" is rotated to the first position 40" to show the positive indication 48" with green color from the green light 16" and so that it obscures the mouth feature 30" when the second element 20" is rotated down to the second position 44" to show the negative indication 52" with red color from the red light 14".

Figure 4:
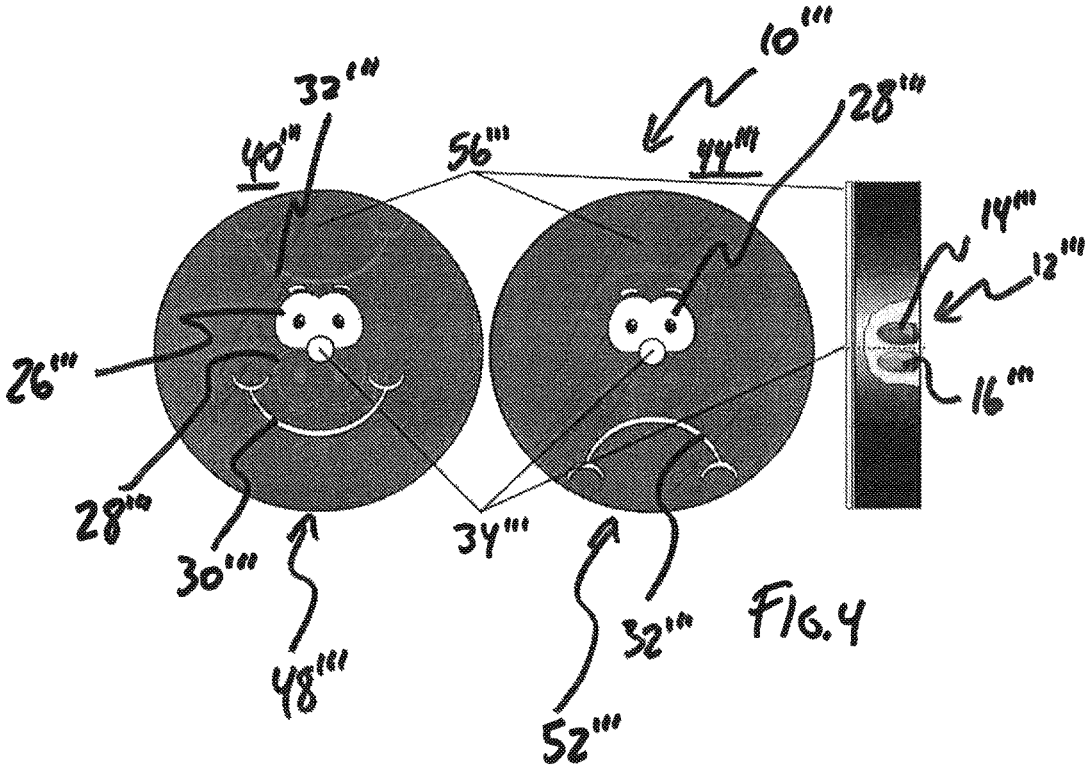
FIG. 4 is a view of an alternate illuminated sign according to an exemplary embodiment of the present invention.

FIG. 4 illustrates an additional embodiment of the illuminated sign 10'", where the light source 12'" has the red light 14'" to emit red color light and the green light 16'" to emit green color light. Additionally, the illuminated sign 10'" includes a rotatable light transmissive element 56'" with a first set of facial features including eye features 26'" and a mouth feature 30'" and a second set of facial features including eye features 28'" and a mouth feature 32'". Upon rotation of the light transmissive element 56'" to a first position 40'" (FIG. 4), the green light 16'" of the light source 12'" is configured to output light of the green color to illuminate the first set of facial features including the eye features 26'" and the mouth feature 30'" with the green color. In the first position 40'", the illumination of the first set of facial features including the eye features 26'" and the mouth feature 30'" with the green color conveys a positive indication 48'" including the mouth feature 30'" being in a smiling orientation. Similarly, upon rotation of the light transmissive element 56'" from the first position 40'" to a second position 44'", the red light 14'" of the light source 12'" is configured to output light of a red color to illuminate the second set of facial features including the eye features 28'" and the mouth feature 32'" with the red color. In the second position 44'", the illumination of the second set of facial features including the eye features 28'" and the mouth feature 32'" with the red color conveys a negative indication 52'" including the mouth feature 32'" being in a sad orientation. As with the previous embodiment of the sign 10 in FIG. 1, a baffle (not shown) is provided behind the rotatable light transmissive element 56'", so that it obscures the eye features 28'" and the mouth feature 32'" when the transmissive element 56'" is rotated to the first position 40'" to show the positive indication 48'" with green color from the green light 16'" and so that it obscures the eye features 26'" and the mouth feature 30'" when the transmissive element 56'" is rotated to the second position 44'" to show the negative indication 52'" with red color from the red light 14'".

Figure 5:
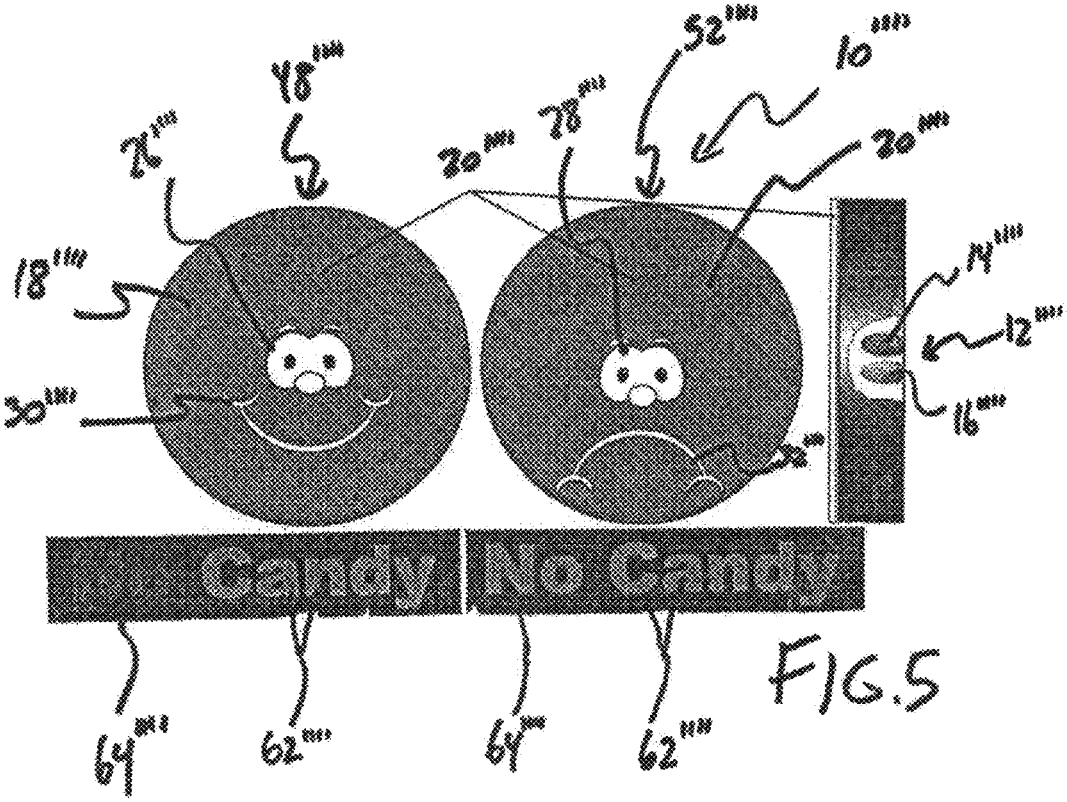
FIG. 5 is a view of an alternate illuminate sign according to an exemplary embodiment of the present invention.

FIG. 5 illustrates an additional embodiment of the illuminated sign 10"" where the light source 12"" has the red light 14"" to emit red color light and the green light 16"" to emit green color light. As illustrated in FIG. 5, the illuminated sign 10"" includes a removable first light transmissive element 18"" with first facial features including eye features 26"" and a mouth feature 30"". The illuminated sign 10"" further includes a removable second light transmissive element 20"" having second facial features including eye features 28"" and a mouth feature 32"". Upon positioning the first light transmissive element 18"" on the illuminated sign 10"", the green light 16"" of the light source 12"" is configured to output light of the green color to illuminate the first set of facial features including the eye features 26"" and the mouth feature 30"" with the green color, to convey a positive indication 48"". Additionally, upon positioning the second light transmissive element 20"" on the illuminated sign 10"", the red light 14""of the light source 12"" is configured to output light of a red color to illuminate the second set of facial features including the eye features 28"" and the mouth feature 32"" with the red color to convey a negative indication 52"".

As further illustrated in FIG. 5, the illuminated sign 10"" includes alphanumeric symbols 62"" that can be used to further convey the positive indication 48"" with green color from the green light 16"", such as alpha characters that spell out "candy" to indicate that candy is in a container in a vicinity of the sign 10"", for example. As further illustrated in FIG. 5, the illuminated sign 10"" also includes alphanumeric symbols 62"", 64"" that can be used to further convey the negative indication 52"" with red color from the red light 14"", such as alpha character that spell out "no candy" to indicate that no candy remains in the container in the vicinity of the sign 10"", for example. In the specific embodiment of FIG. 5, the alphanumeric characters include a first group 62"" of characters and a second group 64"" of characters, in which both groups of characters 62"", 64"" are illuminated by the red light 14"" to convey the negative indication 52"", while only one group of characters 62"" are illuminated by the green light 16"" to convey the positive indication 48"" while the second group of characters 64"" is blocked by a baffle (not shown). However, the embodiments of the present invention are not limited to this specific arrangement, and different groups of characters may be used to convey the positive or negative indication. Although "candy" and "no candy" are shown in FIG. 5 as respective examples of positive and negative alphanumeric phrases, the embodiments of the present invention are not limited to these alphanumeric phrases and include any alphanumeric phrase which could be used to further convey a positive or negative indication of the elements 18"", 20"". Additionally, the alphanumeric symbols of FIG. 5 may be used to further convey the positive or negative indications of the other embodiments of the present invention, and are not limited to the specific embodiment of FIG. 5.

Although the above embodiments of the present invention discuss the application of the illuminated sign with regard to a positive or negative indication of whether or not a container of candy is empty, this is merely one example in which the embodiments of the present invention may be employed and does not limit the scope of the embodiments of the present invention. Indeed, the embodiments of the illuminated sign of the present invention may be applied in any scenario in which a positive indication and a negative indication are desired, including, but not limited to, whether or not a container is empty, whether or not a restroom is occupied, whether or not a parking lot is full, whether or not an establishment is open or closed, whether or not a product is in stock or sold out, and whether or not a lifeguard is on duty.

While the preferred embodiments of the present invention have been shown and described herein, it will be obvious that such embodiments are provided by way of example only and not of limitation. Numerous variations, changes and substitutions will occur to those skilled in the art without departing from the teaching of the present invention. Accordingly, it is intended that the invention be interpreted within the full spirit and scope of the appended claims.

The invention claimed is:

1. An illuminated signage comprising:

first and second light sources capable of producing light of first and second colors, respectively, the first color being substantially different from the second color;

a centrally located sign portion including an illuminatable eyelike element having the appearance of two eyes and positioned so that it can be illuminated by one and/or both of the first and second light sources;

an outside sign portion rotatably disposed around the centrally located sign portion and including illuminatable first and second mouth-like elements respectively disposed on different portions of the outside sign portion and disposed such that, depending on the outside sign portion's rotational orientation with respect to the centrally located sign portion, one at a time of the first and second mouth-like elements can be illuminated by one and/or both of the first and second light sources, the outside sign portion being able to be rotated about the centrally located sign portion to a first position in which the first mouth-like element is situated below the eyelike element of the centrally located sign portion and also able to be rotated about the centrally located sign portion to a second position in which the second mouth-like element is situated below the eyelike element of the centrally located sign portion, the centrally located sign portion and the outside sign portion being disposed such that regardless of whether the outside sign portion is in the first position or in the second position, both the centrally located sign portion and the outside sign portion present themselves to the view of an observer and neither the centrally located sign portion nor the outside sign portion obscures the other or is positioned or superimposed in front of the other; and light selection means for selectively illuminating one or the other of the first and second light sources based on whether the outside sign portion is at the first position or the second position, such that:

when the outside sign portion is in the first position the first light source of the first color illuminates both the eyelike element of the centrally located sign portion and the first mouth-like element of the outside sign portion, resulting in the appearance to the viewer of an illuminated positive or smiling face having an illuminated smiling mouth beneath a pair of illuminated eyes, and when the outside sign portion is in the second position the second light source of the second color illuminates both the eyelike element of the centrally located sign portion and the second mouth-like element of the outside sign portion, resulting in the appearance to the viewer of an illuminated negative or unsmiling face having an illuminated unsmiling or frowning mouth beneath a pair of illuminated eyes.

2. The illuminated signage of claim 1, wherein at least one of the illuminated smiling and unsmiling faces is reasonably reminiscent of a human or cartoon face.

3. The illuminated signage of claim 1, wherein at least one of the illuminated smiling and unsmiling faces is reasonably reminiscent of a jack-o'-lantern.

4. The illuminated signage of claim 1, including a light baffle disposed between a portion of the outside sign portion and the first and second light sources so as to keep the second mouth-like element from being illuminated by the first light source when the outside sign portion is in the first position and to keep the first mouth-like element from being illuminated by the second light source when the outside sign portion is in the second position.

* * * * *